US009260222B2

(12) United States Patent
Khatchaturian

(10) Patent No.: US 9,260,222 B2
(45) Date of Patent: Feb. 16, 2016

(54) COVER DEVICE FOR A LID OF A CONTAINER

(71) Applicant: Armen Khatchaturian, Glendale, CA (US)

(72) Inventor: Armen Khatchaturian, Glendale, CA (US)

( * ) Notice: Subject to any disclaimer, the term of this patent is extended or adjusted under 35 U.S.C. 154(b) by 101 days.

(21) Appl. No.: 13/784,646

(22) Filed: Mar. 4, 2013

(65) Prior Publication Data

US 2013/0228584 A1 Sep. 5, 2013

Related U.S. Application Data

(60) Provisional application No. 61/606,298, filed on Mar. 2, 2012.

(51) Int. Cl.

| | |
|---|---|
| ***F21V 33/00*** | (2006.01) |
| ***A47G 19/22*** | (2006.01) |
| ***B65B 7/28*** | (2006.01) |
| ***B65D 25/00*** | (2006.01) |

(52) U.S. Cl.

CPC ..... *B65D 25/00* (2013.01); *A47G 19/2211* (2013.01); *B65B 7/2842* (2013.01); *F21V 33/0036* (2013.01); *A47G 2019/2238* (2013.01); *Y10T 29/49778* (2015.01)

(58) Field of Classification Search

CPC ..... B65D 5/68; B65D 5/685; B65D 25/00; B65D 7/28; B65D 7/2807; B65D 7/2814; B65D 7/2842; Y10T 29/49778; A47G 19/2205; A47G 19/2211; A47G 19/2227; A47G 2019/2238; F21V 33/0024; F21V 33/0036

USPC ..... 220/288, 293, 304, 367.1, 703, 705, 220/711, 713, 716, 718; 362/96, 101, 154; 40/311, 324, 564

See application file for complete search history.

(56) References Cited

U.S. PATENT DOCUMENTS

| | | | | |
|---|---|---|---|---|
| 1,641,743 | A | | 9/1927 | Dawson |
| 1,878,343 | A | | 9/1932 | Stone |
| 1,954,422 | A | | 4/1934 | McIntyre |
| 2,694,517 | A | | 11/1954 | Pennestri |
| 2,836,948 | A | | 6/1958 | Austin |
| 2,985,044 | A | * | 5/1961 | Gill ..... B67B 7/18 81/3.4 |
| 4,001,904 | A | | 1/1977 | Gill |
| 4,068,449 | A | | 1/1978 | Harper |
| 4,410,102 | A | | 10/1983 | Lutzker |

(Continued)

FOREIGN PATENT DOCUMENTS

FR 610998 A 8/1926

OTHER PUBLICATIONS

Patent Translate by EPO and Google, Description FR610998, "A closure system for a container", Sep. 17, 1926.*

(Continued)

*Primary Examiner* — Alan Cariaso

(74) *Attorney, Agent, or Firm* — Lewis Roca Rothgerber Christie LLP

(57) ABSTRACT

The present invention is directed to a cover device for more hygienic handling of a lid for a container. In general, the cover device fits over the lid and releasably grips the outer surface of the lid. The cover device includes a seating member for sealing an opening in the lid. The cover device may also have paper and/or electronic advertisements. Electronic advertisements are displayed on an LED system in the cover device, and the LED system may transmit and receive wireless data.

14 Claims, 15 Drawing Sheets

(56) References Cited

U.S. PATENT DOCUMENTS

| | | | | |
|---|---|---|---|---|
| 4,726,487 | A | 2/1988 | Mitri | |
| 4,760,763 | A | 8/1988 | Trick et al. | |
| 4,766,781 | A | 8/1988 | Grise et al. | |
| 4,971,222 | A | 11/1990 | Rohde et al. | |
| 5,000,338 | A * | 3/1991 | Wolman | 220/718 |
| 5,054,640 | A * | 10/1991 | Tucker | 220/716 |
| 5,231,733 | A | 8/1993 | Dittman | |
| 5,765,716 | A | 6/1998 | Cai et al. | |
| 5,784,933 | A | 7/1998 | Persellin | |
| 5,947,324 | A * | 9/1999 | Palinchak | 220/713 |
| 6,578,726 | B1 | 6/2003 | Schaefer | |
| 6,978,910 | B2 | 12/2005 | Sanders et al. | |
| 7,021,481 | B2 * | 4/2006 | St. Germain et al. | 220/254.2 |
| 7,044,317 | B2 * | 5/2006 | Smith et al. | 215/235 |
| 7,156,253 | B2 | 1/2007 | Ziegler | |
| 7,240,935 | B2 | 7/2007 | Schmierer et al. | |
| 7,303,086 | B2 | 12/2007 | Nhan et al. | |
| 7,686,183 | B2 | 3/2010 | Ziegler | |
| 7,748,293 | B2 | 7/2010 | Elwell | |
| 8,069,751 | B2 | 12/2011 | Barton | |
| 8,397,940 | B2 * | 3/2013 | Steininger | 220/714 |
| 8,528,768 | B2 * | 9/2013 | D'Amato | 220/253 |
| 8,720,740 | B2 * | 5/2014 | Bratsch | 220/821 |
| 2003/0089713 | A1 | 5/2003 | Belt et al. | |
| 2003/0192891 | A1 | 10/2003 | Ziegler | |
| 2005/0193867 | A1 | 9/2005 | Haynes | |
| 2006/0027588 | A1 | 2/2006 | Mackovic-Basic et al. | |
| 2006/0231563 | A1 * | 10/2006 | Olivar | 220/780 |
| 2006/0283859 | A1 * | 12/2006 | Lu | 220/253 |
| 2008/0308519 | A1 | 12/2008 | Farrar et al. | |
| 2009/0283526 | A1 | 11/2009 | Pierce et al. | |
| 2010/0270257 | A1 * | 10/2010 | Wachman et al. | 215/228 |

OTHER PUBLICATIONS

Office action mailed by the USPTO on Aug. 14, 2014 for U.S. Appl. No. 13/081,372, 15 pages.

Office action mailed by the USPTO on Jan. 12, 2015 for U.S. Appl. No. 13/081,372, 16 pages.

* cited by examiner

COVER DEVICE FOR A LID OF A CONTAINER

CROSS-REFERENCE TO RELATED APPLICATION(S)

The present application claims priority to and the benefit of U.S. Provisional Application Ser. No. 61/606,298 filed on Mar. 2, 2012, the entire contents of which are incorporated herein by reference.

FIELD

The invention is directed to a cover device for more hygienic, safe and improved handling and use with a lid for a container.

BACKGROUND

Takeout beverages such as coffee and coffee drinks, tea and tea drinks, soft drinks, smoothies, milkshakes, other frozen beverages and other beverages are commonly sold in disposable containers (cups) with plastic lids. Frequently, the server, the customer of a self-service beverage, or other operator manually places the lid on the cup before or after the cup is filled with the beverage. The operator must press around the entire circumference of the lid to ensure that the lid is sealed to the cup to avoid spills. Accidental spills may result if the operator fails to seal around the entire lid. This manual handling can also be unhygienic, especially when the operator touches the inner surface of the lid, which contacts the beverage in the cup, or a drinking opening, which is a part of the lid that is intended to be drunk from without a straw. These beverages are often not consumed upon purchase, or may be consumed slowly and a warm beverage in the cup may decrease in temperature, and a cool beverage in the cup may increase in temperature.

Some establishments that serve beverages attempt to protect the outer surface of the lid from contamination by placing the stack of disposable lids so that the inner surface of the lid is facing up. However, this "upside down" technique allows the inner surface, which contacts the beverage in the cup, to be exposed to possible contamination. This technique also does not prevent. the operator from touching the drinking opening when sealing the lid to the cup.

Additionally, disposable cups are common in public and offer a visible medium for communication.

SUMMARY

An embodiment of the present invention is directed to a cover device for more hygienic, safe and versatile handling of a lid for a container. In general, the cover device fits over the lid and releasably grips the outer surface of the lid, and then seals to the lid. The cover device completely covers the lid thereby imparting additional insulation to the container lid and protecting the lid from contaminants to maintain a clean, hygienic lid. The cover device is also a splash guard retaining any liquid in the container from spilling out of any opening in the lid. In some embodiments, the cover device has a piece, or protrusion that fits into an opening of the lid, thereby plugging the opening and preventing the liquid in the container from spilling. In other embodiments, the cover device has a flat piece that corresponds to and seals an opening in the lid, thereby preventing any liquid in the container from spilling.

In other aspects of the present invention, the cover device for the lid provides a visible surface for advertisements. In some embodiments, the cover device for the lid has print ads attached to it. Additionally, the cover device may be made from print ads. In other embodiments, the cover device includes a space for electronic advertisements. In some embodiments, the cover device has a small light emitting diode (LED) screen. The LED screen may include a battery power supply, and/or photo cell power source. The power source may also include a cell phone connection for electronic advertisements. The LED screen may also include a wireless network access point, e.g. Wifi. In some embodiments, the network access point on the cover device picks up signals from the surroundings, e.g. stores, businesses, stadiums, and provides updates on products or promotions from the surroundings, e.g. score updates and/or promotional products.

BRIEF DESCRIPTION OF THE DRAWINGS

These and other features and advantages of the present invention will be better understood by reference to the following detailed description when considered in conjunction with the attached drawings.

DETAILED DESCRIPTION

Figure 1A:
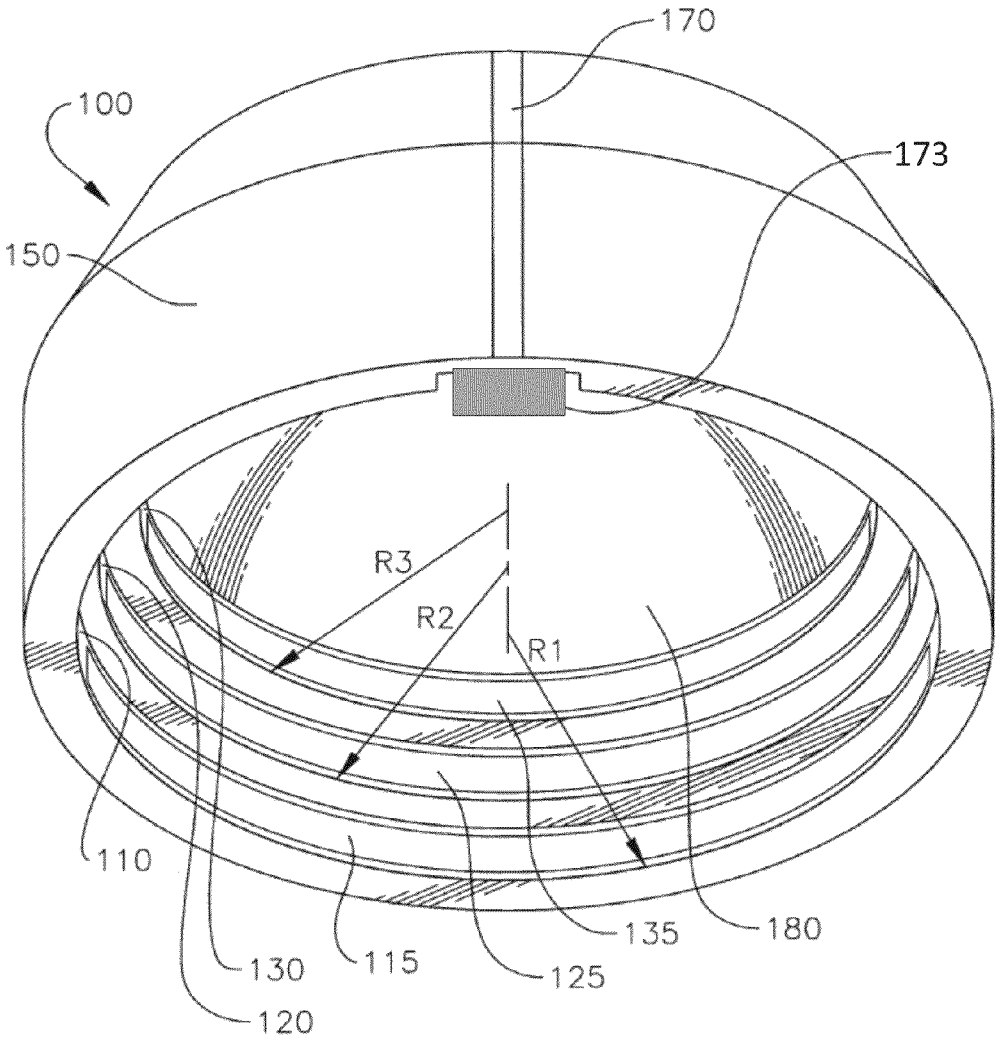
FIG. 1A is a perspective view of a cover device according to an embodiment of the invention.

With reference to FIGS. 1A, 1B, 1C, and 3B, a cover device 100 has an outer surface 150, a top 160 and an inner chamber or cavity 180. The cover device 100 is configured to engage and grip a lid 200 (e.g., as shown in FIG. 2A) for a container, to then be placed on the container (cup) and sealed to the lid using the cover device. In one embodiment, the cover device is substantially cylindrical with an open end and a closed end. In this embodiment, the outer surface is formed by the wall of the cylinder, the closed end forms the top 160, and the inner chamber or cavity 180 is formed in the open end.

An operator holds the cover device 100 by the outer surface 150. In the embodiment. shown in FIGS. 1A, 1B, and 1C, the outer surface 150 is cylindrical. However the outer surface may be formed to any shape or size compatible with the inner chamber or cavity 180. For example, the outer surface 150 may be asymmetric, domed, cupped, ergonomically shaped or otherwise shaped. The outer surface 150 may further include a handle or other feature that is decorative or assists the operator in handling the cover device 100.

Figure 1B:
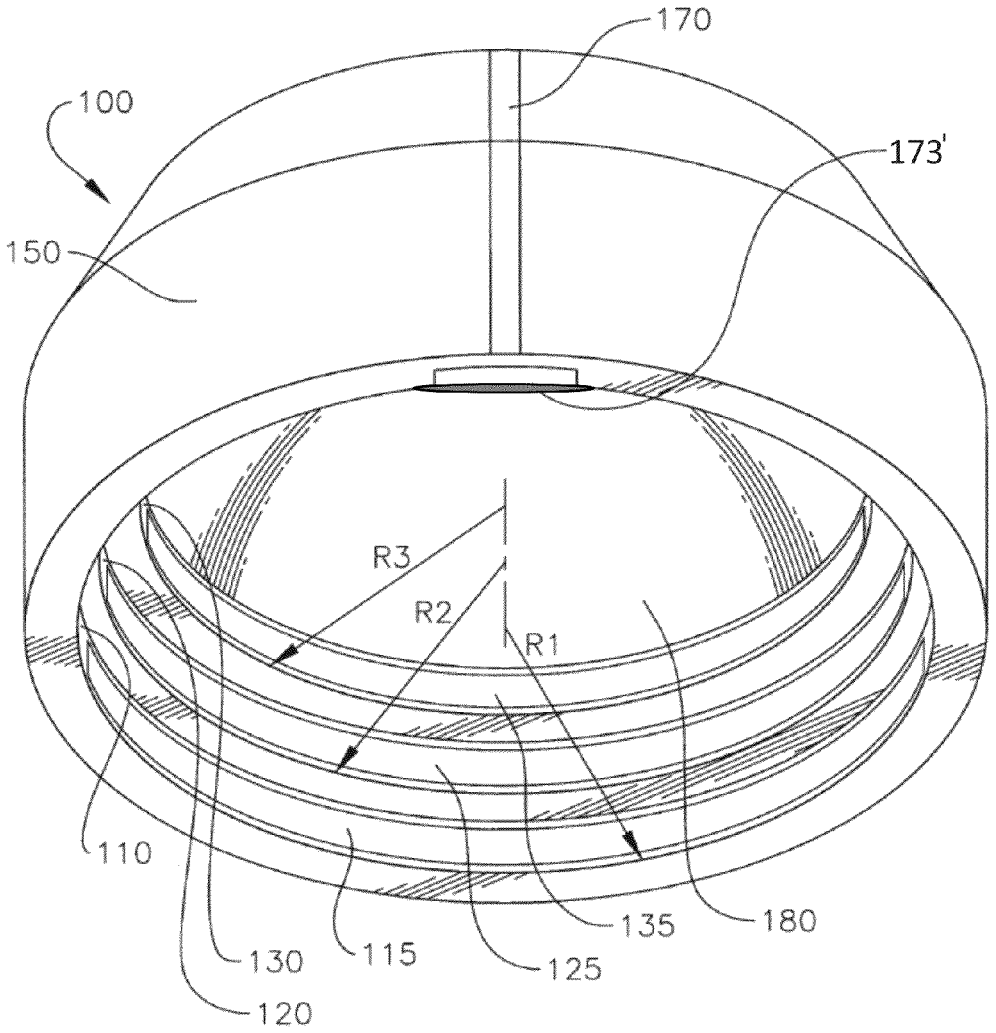
FIG. 1B is a perspective view of a cover device according to an embodiment of the invention.
Figure 1C:
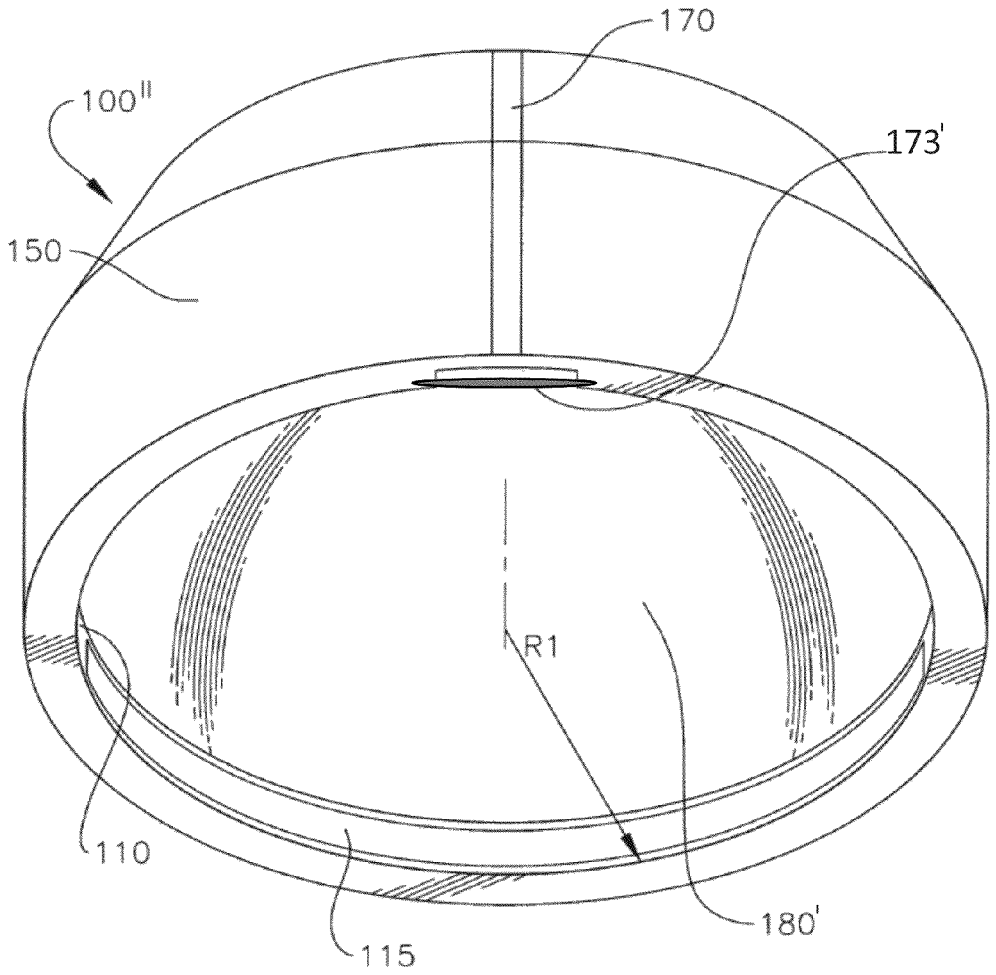
FIG. 1C is a perspective view of a cover device according to an embodiment of the invention.
Figure 2A:
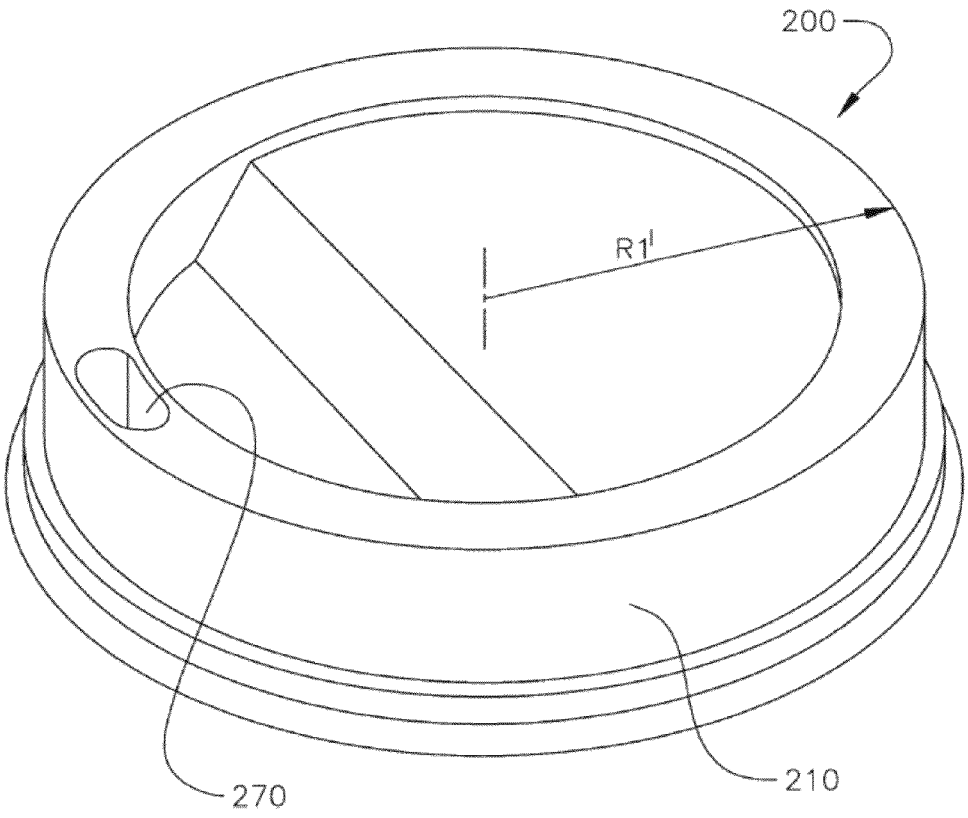
FIG. 2A is a perspective view of a lid.

With reference to FIGS. 1A, 1B, and 1C, the inner chamber or cavity 180 of the cover device includes a first inner engagement surface 110 configured to engage with the lid 200 by having a shape that is substantially congruous to at least a part of the lid 200. In one embodiment, the lid 200 includes a cylindrical outer surface 210 having a radius of R1' (shown in FIG. 2A). In this embodiment, the first inner engagement surface 110 is a cylindrical surface having a radius of R1 and is configured to be substantially parallel to the outer surface 210 of the lid 200 when the cover device 100 engages the lid 200. R1 may be slightly larger than R1' but is sized to allow the first inner engagement surface 110 to fit in sealing engagement with the lid 200.

Figure 2B:
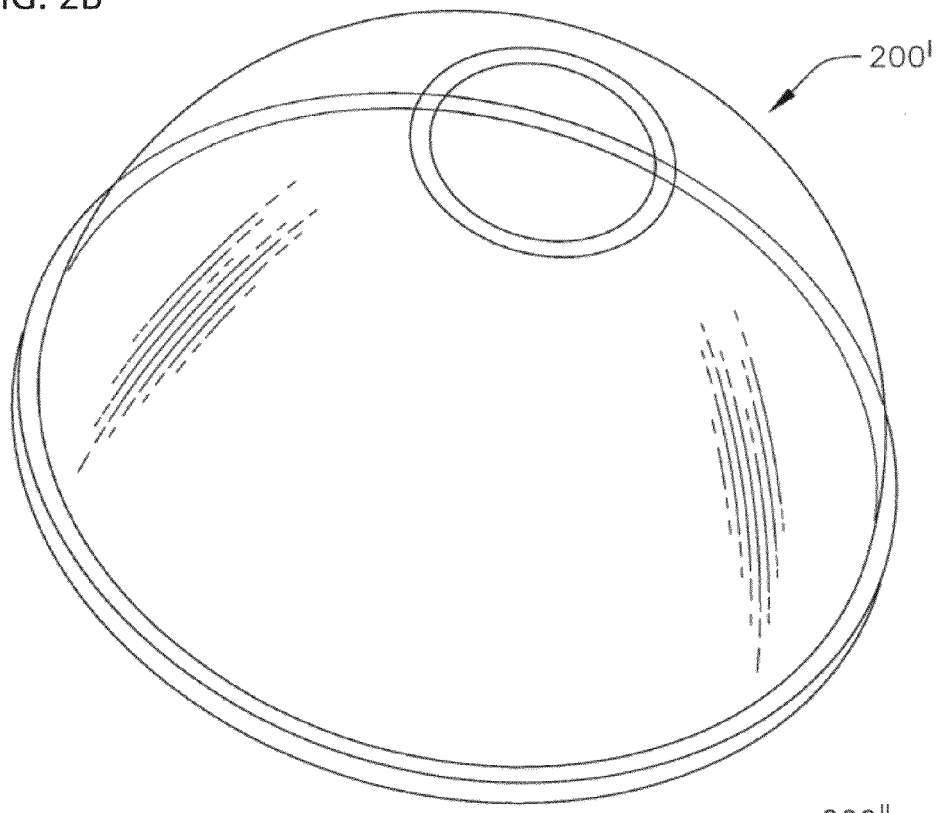
FIG. 2B is a perspective view of a dome-shaped lid.
Figure 2C:
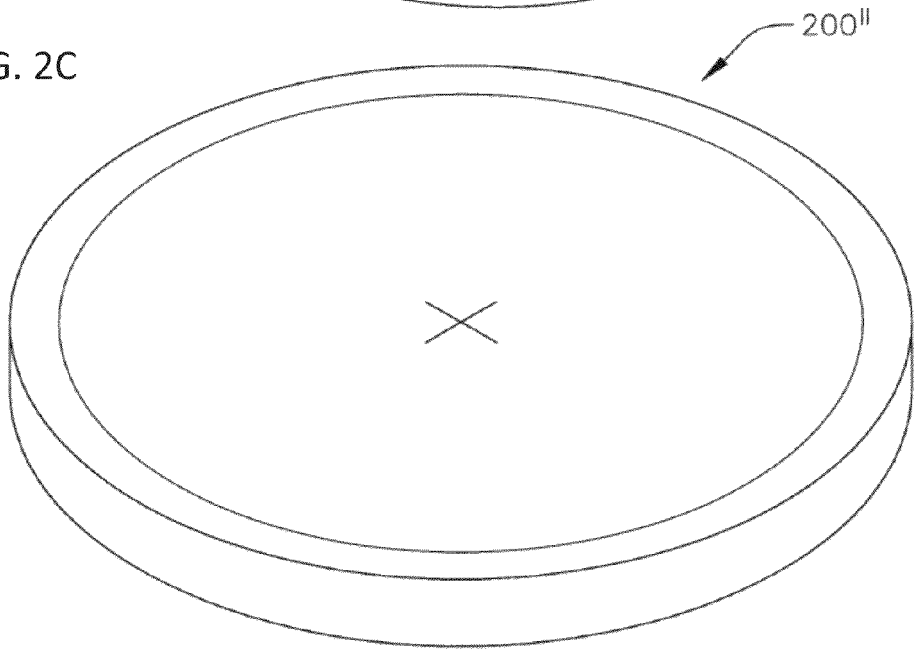
FIG. 2C is a perspective view of a substantially flat lid.
Figure 3A:
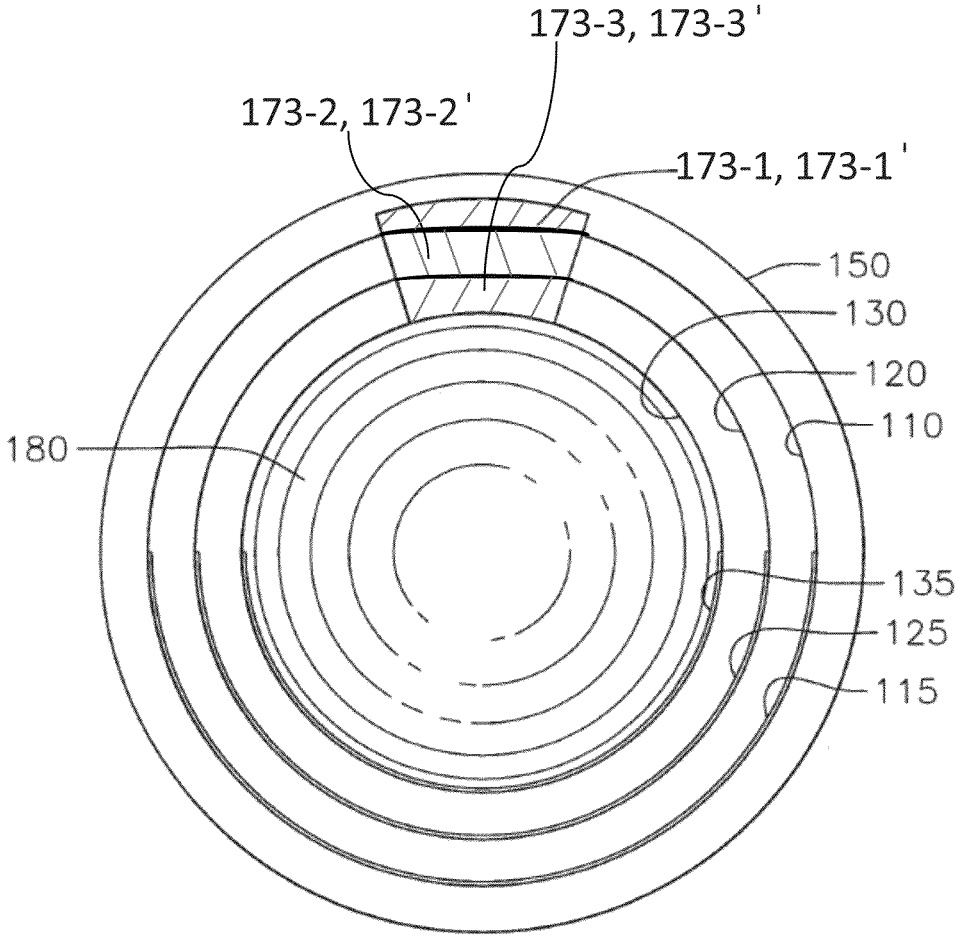
FIG. 3A is a bottom view of the cover device according to FIG. 1A.
Figure 3B:
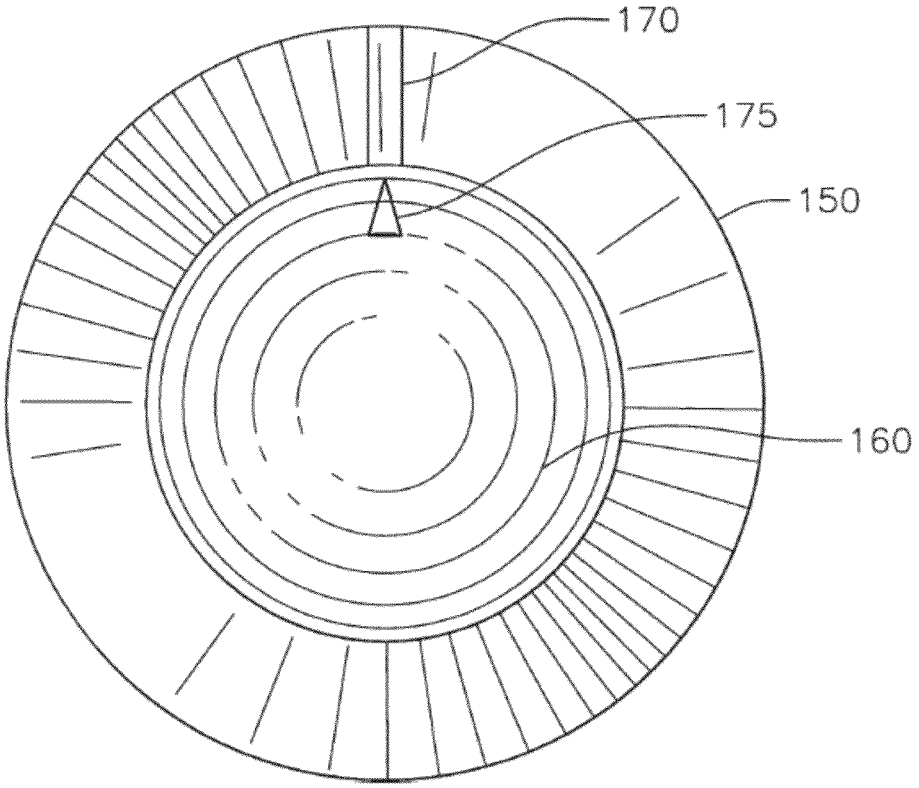
FIG. 3B is a top view of the cover device according to FIG. 1A.
Figure 3C:
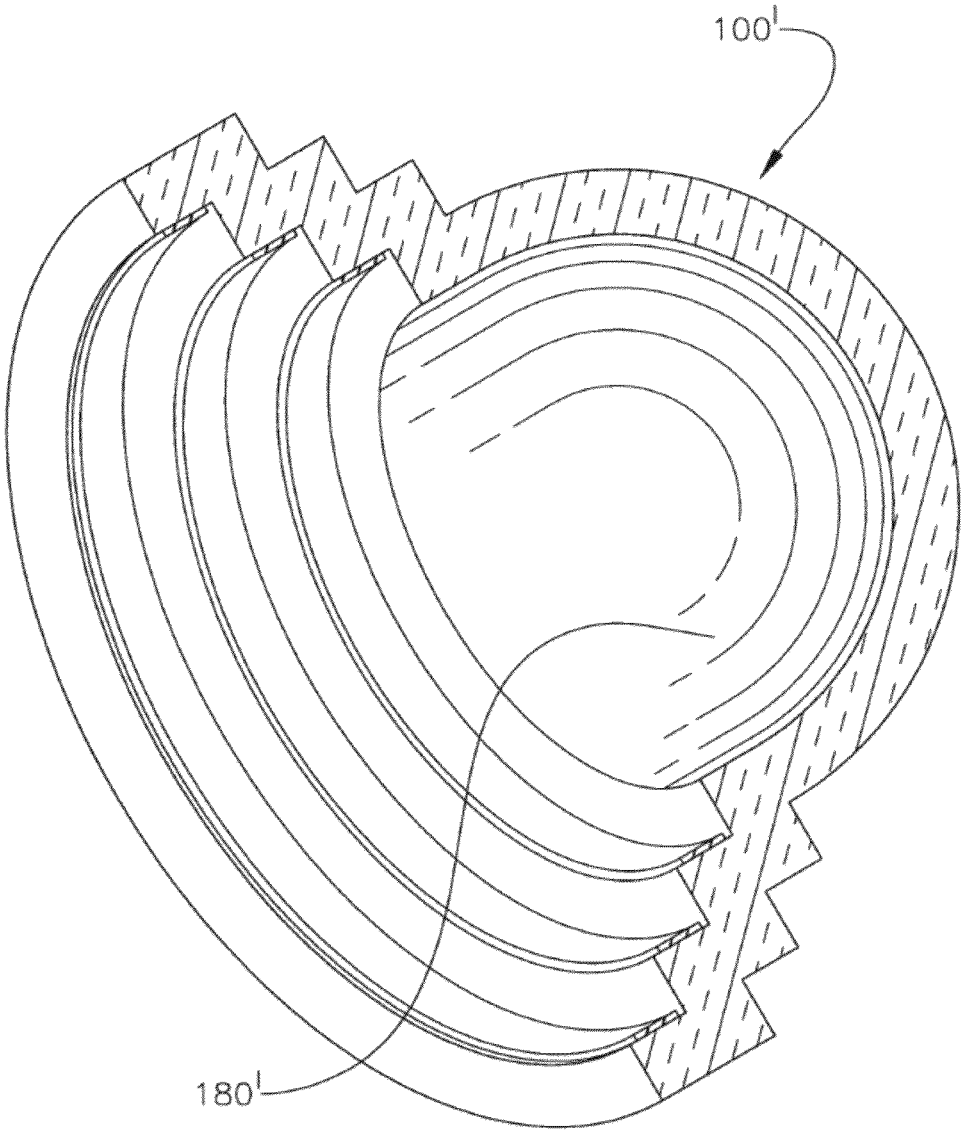
FIG. 3C is a cross-sectional perspective view of another embodiment of a cover device.

The inner chamber or cavity 180 is configured to allow engagement between the first inner engagement surface 110 with the outer surface 210 of the lid 200 by having sufficient space to receive parts of the lid 200 that protrude above the outer surface 210 of the lid 200 that is engaged by the cover device 100. In particular, as shown in FIG. 1A, a portion of the outer surface 210 of the lid 200 may extend into the inner chamber or cavity 180 when the cover device 100 is placed over the lid 200. The cover device 100 and the inner chamber or cavity 180 may take any size or shape to accommodate any size, type or number of lids. For example, the inner chamber or cavity 180 may be sized and shaped to fit a lid typically used to cover hot beverages, as shown in FIG. 2A. Alternatively, as shown in FIG. 3C, a cover device 100' may have a more domed shape with a dome-shaped inner chamber or cavity 180' for fitting a lid 200' typically used on frozen beverages such as milkshakes, smoothies or the like, as shown in FIG. 2B. In embodiments like this, the cover device can have a hole in any position to accommodate a straw. As another example, the cover device may be substantially flat with only enough space in the inner chamber or cavity 180 to accommodate a lid 200" generally used to cover soft drinks, as shown in FIG. 2C.

To assist in the sealing of the lid 200, the first inner engagement surface 110 of the cover devices of FIGS. 1A, 1B, and 1C, may have a first sealing segment 115. In one embodiment, the first sealing segment 115 covers all or a portion of the first inner engagement surface 110. The sealing segment 115 may include, by way of example, a textured surface, a layer of adhesive, or a rubber or rubberized layer. However, the sealing segment is not limited in this manner, and can include any mechanism for enhancing the grip and seal of the device on the lid. For example, an alternative sealing segment may include a series of spring-loaded ball bearings, a tube insert in a cavity, a rubber tube or similar, or the like.

In one embodiment, the lid 200 has a drinking opening 270 that a consumer may drink from. In one embodiment, shown in FIGS. 1A and 3A, the first engagement portion 110 of the cover device includes a protrusion 173 for insertion into the opening 270 of the lid. When the protrusion 173 is in the opening 270 of the lid, and the lid is fitted onto the container, the liquid in the container is less likely to spill out of the opening. Additionally, when the cover device 100 is fitted to the lid 200 that is fitted to a container, the liquid in the container is further insulated by the cover device 100. The cover device may have an optional indicator arrow 175 on the top 160 and/or an optional indicator line 170 along the outer surface 150 that indicates the location of the protrusion 173 to guide placement of the cover device 100 over the drinking opening 270 of the lid 200. This is useful, for example, for more efficient and faster fitting of the cover device 100 onto the lid 200.

In some embodiments, the protrusion 173 is made from any suitable material. For example, the protrusion is made from rubber or plastic. In an alternative embodiment, the cover device has a flat sealing member 173' (shown in FIG. 1B) that fits over the drinking opening 270, but does not insert into the opening 270. The flat sealing member 173' is made from any suitable material, and for example, can be made from rubber or plastic.

In another embodiment, the outer surface 210 of the lid 200 is asymmetric and the indicator arrow 175 and/or indicator line 170 assist in aligning the cover device 100 with the lid 200 to allow the cover device 100 to effectively engage and grip the lid 200.

In one embodiment, the cover device 100 has more than one engagement surface so that a single cover device can be used to place differently sized lids on containers of different size or type. For example, the cover device 100 shown in FIGS. 1A, 1B, and 3A has three engagement surfaces 110, 120 and 130. Each engagement surface 110, 120 and 130 may have a sealing segment 115, 125 and 135, and a protrusion 173-1, 173-2 and/or 173-3, in a cover device as shown in FIGS. 1A and 3A, or a flat sealing member 173-1', 173-2', and/or 173-3' in a cover device as shown in FIGS. 1B and 3A. The first engagement surface 110 has an inner radius of R1 and is configured to grip a first lid with an outer surface radius of R1'. Similarly, the second engagement surface 120 has an inner radius of R2 and is configured to grip a second lid with an outer surface radius of R2', and the third engagement surface 130 has an inner radius of R3 and is configured to grip a third lid with an outer surface radius of R3'. R2' and R3' each correspond to the radius of a lid having a smaller diameter than the lid shown in FIG. 2A having a radius of R1'. That is, a lid having a radius of R2' has a smaller diameter than a lid having a radius of R1', and a lid having a radius of R3' has a smaller diameter than a lid having a radius of R2'.

R2 and R2' and R3 and R3' have dimensions that satisfy the conditions stated above with reference to R1 and R1', R2 and R2' and R3 and R3'. As shown in FIG. 3A, the first engagement portion 110, the second engagement portion 120 and the third engagement portion 130 include protrusions 173-1, 173-2, and/or 173-3 that insert into the drinking opening 270. Alternatively, the cover device may have a single engagement surface to accommodate lids having outer surfaces of the same radius but having different shapes or forms above or below the outer surface. In one embodiment, the cover device has two engagement surfaces and two protrusions (173-1, 173-2) or fiat sealing members (173-1', 173-2') to accommodate two lid sizes for even greater versatility. Yet another embodiment may have more than three engagement surfaces and three protrusions (173-1, 173-2, 173-3) or flat sealing members (173-1', 173-2', 173-3') to accommodate more than three lid sizes or types and drinking opening positions.

Another embodiment of the cover device 100", shown in FIG. 1C, is designed for use with only one type of lid, for example the lid shown in FIG. 2A. The cover device 100" has one engagement surface 110 having a radius of R1, where R1 is sized as described above in reference to cover device 100. In an embodiment, the cover device 100" has a sealing segment 115 and one protrusion 173, or flat sealing member 173' which are substantially the same as the sealing segment 115 and protrusion 173 or flat sealing member 173', as described above in reference to the cover device 100.

As discussed in various embodiments above, the cover device of the present invention fits over a lid and releasably grips the outer surface of the lid. When the cover device completely covers the lid, it provides additional insulation to the container lid and protects the lid from contaminants to maintain a clean, hygienic lid. A cover device when fitted to a lid is also a splash guard retaining any liquid in the container from spilling out of the opening in the lid. In some embodiments, the cover device has a piece, or protrusion that fits into an opening of the lid, thereby plugging the opening and preventing the liquid in the container from spilling.

In some embodiments, the cover device may be made of any suitable material, without limitation. For example, the cover device may be made of a disposable material and therefore may be disposable. Alternatively, the cover device may he made of a durable material and may be reusable.

The cover device is not limited to using only friction to grip the lids, but may grip the lid by other methods, such as vacuum, suction cups or magnets.

The embodiments described herein include lids for containers. The lid may be a lid for any type of container, for example a lid for a cup, bowl, or other container. The lid may he disposable or reusable. The cup, howl or other container may be disposable or reusable, In one embodiment, the sealing device is configured to place a disposable lid onto a disposable cup. Alternatively, the cover device may be used to engage any type of object.

The embodiments described herein include a cover device of various thicknesses. That is, the thickness of the cover device of the present invention is not limited and may be increased to fit a variety of lid sizes and provide more insulation, and the cover device may he less thick to appear more sleek. The cover device may be sleek and may be configured to fit one size lid, or sleek and fitting more than one size lid.

To use the cover device 100, the operator fits the cover device 100 over the lid 200 of the container. When the cover device 100 is placed over the lid 200, the engagement surface 110, the sealing segment 115 and possibly the inner chamber or cavity 180 acts to grip the lid 200. In another embodiment, vacuum, suction cups or magnets may be used to grip the lid 200. The lid 200 is not released until after the lid is placed on the container. Once the operator has placed the cover device 100 and lid 200 over the container, the operator presses the cover device 100 toward the container, which in turn presses the lid 200 toward the cup to facilitate sealing of the lid 200 around the entire circumference of the container. The cover device 100 thereby increases safety by preventing accidental spills from improperly sealed lids. By using the cover device 100, the lid 200 may be handled and sealed onto the container without the operator's hand touching any part of the lid 200 itself.

Figure 4:
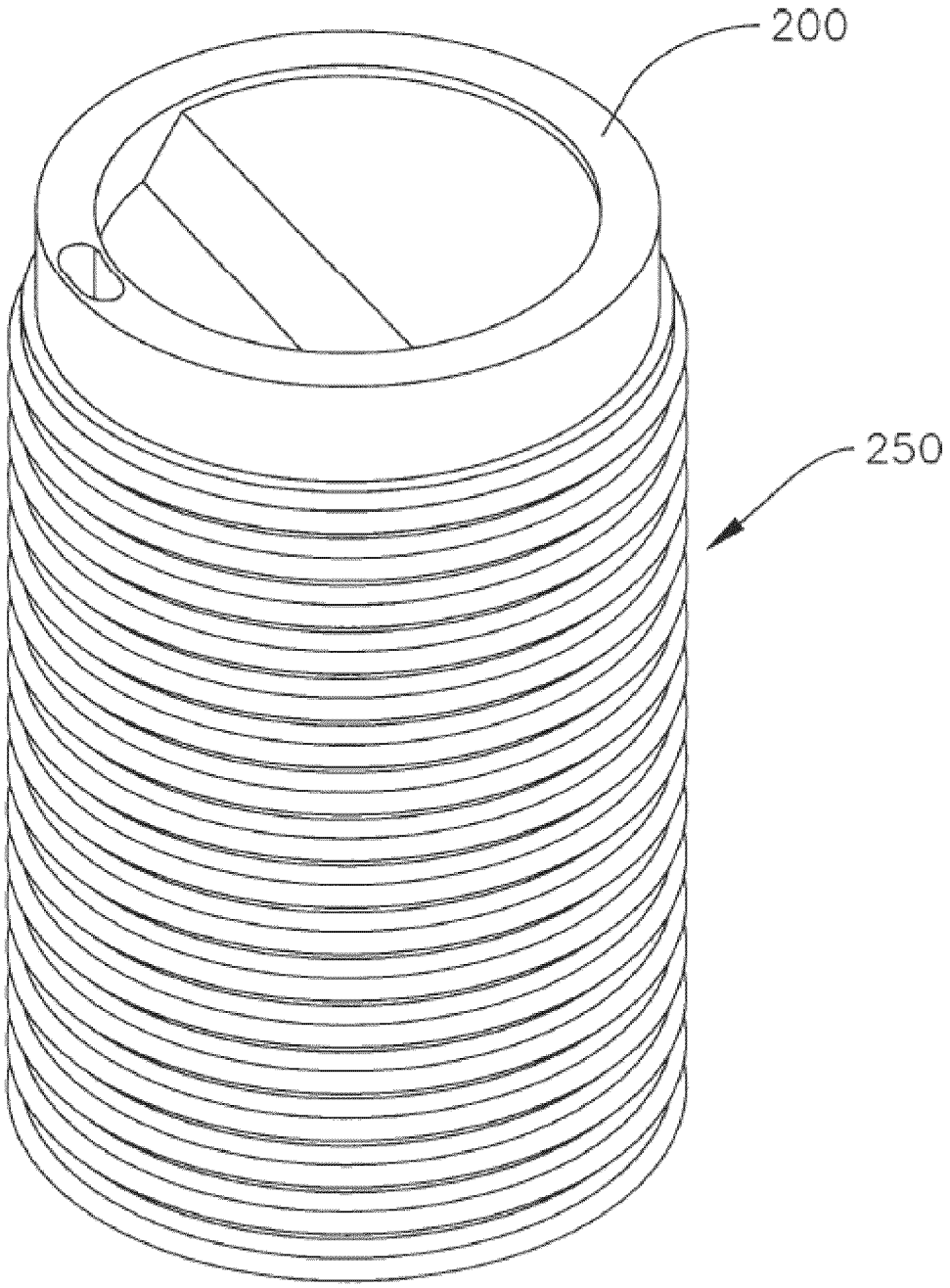
FIG. 4 is a perspective view of a stack of lids.

In one embodiment, the cover device can be used to engage and handle a lid on a stack of a plurality of lids 250, as shown in FIG. 4. The cover device 100 is fitted over the topmost lid 200 on the stack 250 to engage that lid and remove the lid from the stack for transfer to a cup. The cover device is then used, as discussed above, to place, cover, and seal the lid on the cup.

Figure 5:
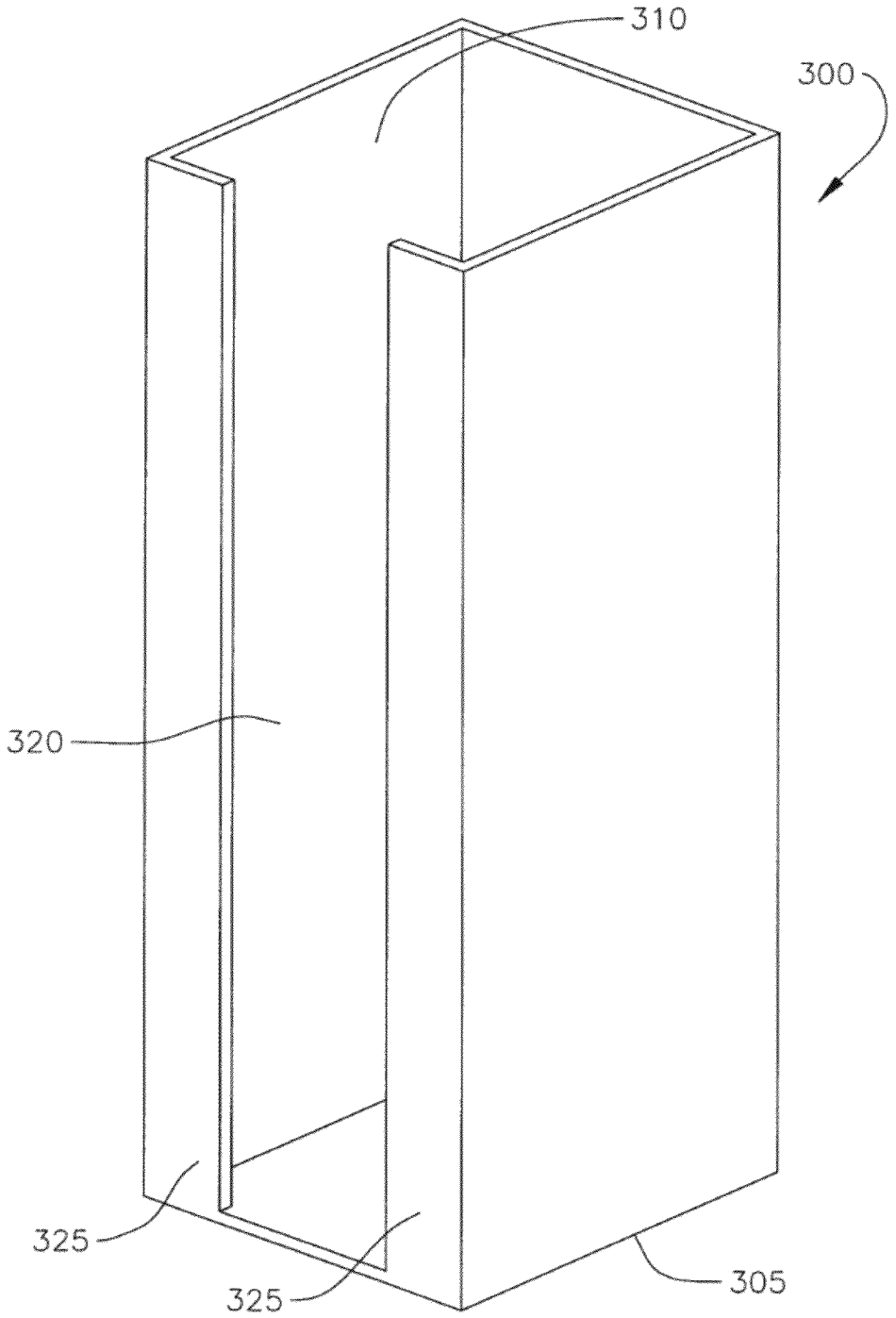
FIG. 5 is a perspective view of a container for a stack of lids.
Figure 6A:
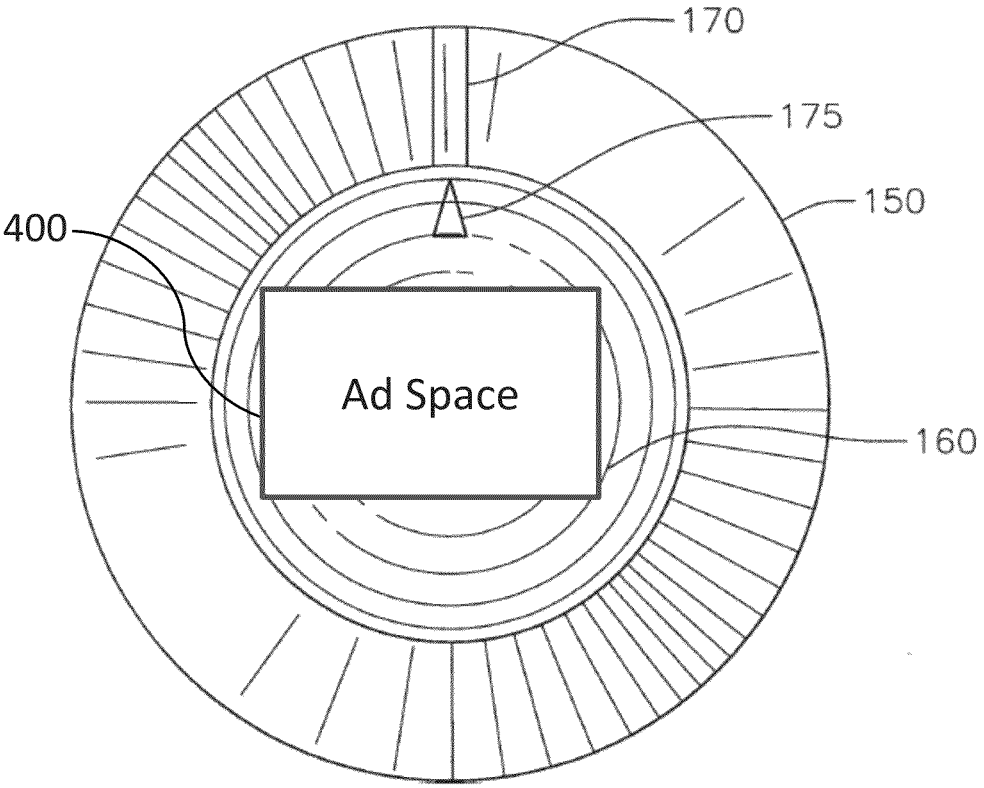
FIG. 6A is a top view of the cover device of FIG. 3B having an ad space, according to embodiments of the present invention.
Figure 6B:
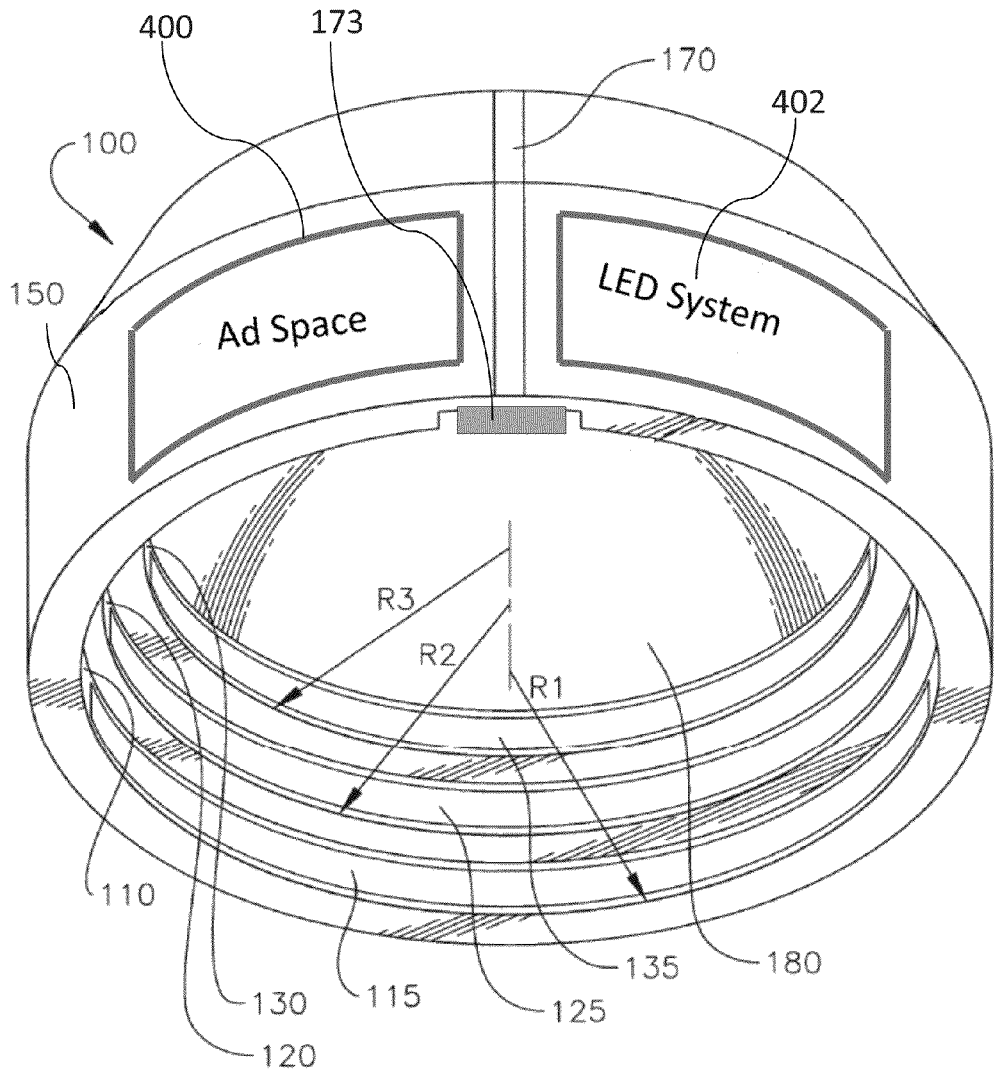
FIG. 6B is a perspective view of the cover device of FIG. 1A having print ads and LED system with electronic advertisements, according to embodiments of the invention.
Figure 6C:
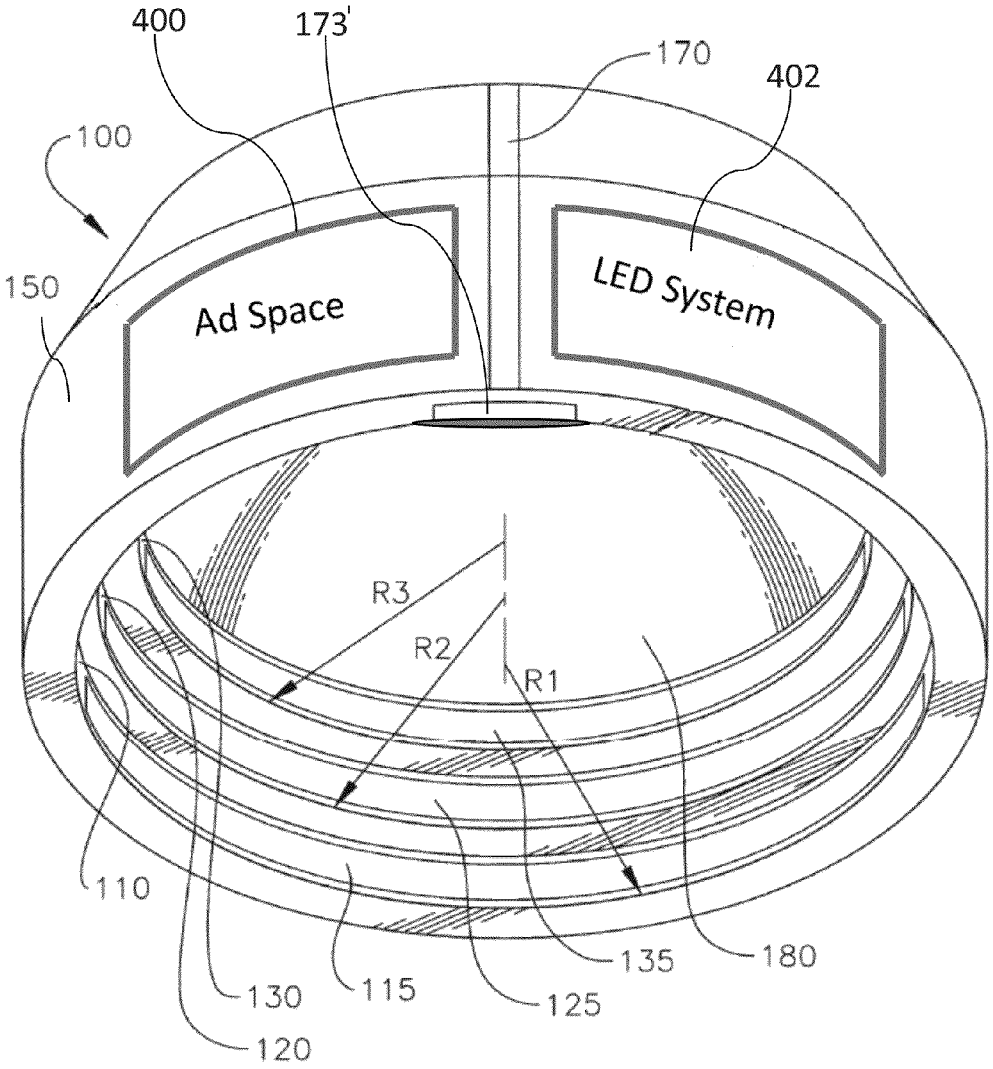
FIG. 6C is a perspective view of the cover device of FIG. 1B having print ads and LED system with electronic advertisements, according to embodiments of the invention.
Figure 6D:
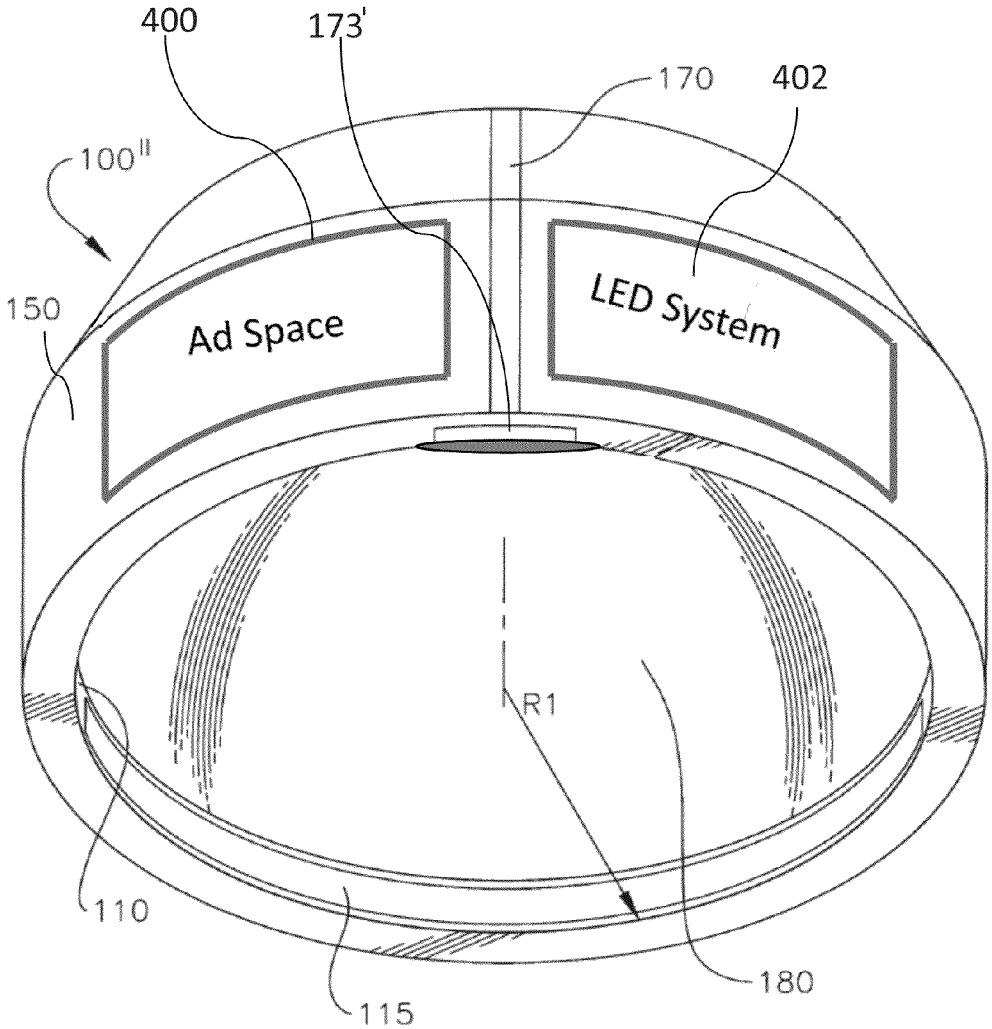
FIG. 6D is a perspective view of the cover device of FIG. 1C having print ads and LED system with electronic advertisements, according to embodiments of the invention.

In another embodiment, as shown in FIG. 5, the stack of lids 250 is disposed in a stack container 300 that holds the stack of lids secure and prevents or reduces environmental contamination of the stack of lids. In addition, the stack container 300 allows a topmost lid 200 of the stack 250 to be engaged by the cover device 100. In one embodiment, the stack container 300 is in the shape of a tall rectangular prism resting on a bottom face 305. The stack container 300 has an open top 310 and an open side 320. The open side 320 includes a retaining feature 325 along each edge extending from the bottom face 305 toward the open top 310. The stack 250 can be loaded into the stack container 300 from the open top 310, and the retaining features 325 prevent the stack 250 from spilling out of the open side 320 of the stack container. The retaining features 325 are dimensioned to allow a user to use the cover device 100 to grip the top lid 200 of the stack 250 and remove the cover device and the engaged lid from the stack container 300 via the open top 310. In addition, the stack container 300 and retainer features 325 are dimensioned to allow the user to engage a final lid resting on the bottom of the stack container.

In one embodiment, the cover device 100 is stored in a device container when not in use. For example, the device container may be a dish or a tray. The device container allows the cover device 100 to be easily grasped by the user. In addition, the device container prevents or reduces environmental contamination of the cover device 100. As would be understood by those of ordinary skill in the art, the device container can take on any size or shape suitable for containing or fitting the cover device. Also, if desired, and depending on the composition of the cover device, the device container may include a non-toxic sterilizing or sanitizing solution to keep the sealing device sterile or sanitary between uses.

In other aspects of the present invention, the cover device for a lid (100) (as shown in FIGS. 6A, 6B, 6C, and 6D) may provide one or more surfaces for advertisements, referred to as an advertisement space or ad space (400). For example, the top (160) of the cover device (shown in FIG. 6A) and/or the circumferential side surface (150) of the cover device (shown in EEGs. 6B, 6C, and 6D) may include an ad space (400). In some embodiments, the cover device for the lid has print ads attached to it. Additionally, the cover device may be made wholly or partially from print ads. In other embodiments, the cover device has a small LED system (402) in the ad space (400). In some embodiments, the LED system (402) includes an LED display (405) and is positioned on the circumferential side surface (150) of the cover device to display advertisements in the form of a ticker, similar to the ticker for a stock report. In other embodiments, the cover device having an LED system (402) displays electronic advertisements. The cover devices shown in FIGS. 6B, 6C, and 6D, have both the paper and electronic advertisements in one cover device. However, a cover device may include both paper and electronic advertisements, or may only have one of these modes of advertisement in one or both positions on the side surface (150) and/or the top (160).

Figure 7:
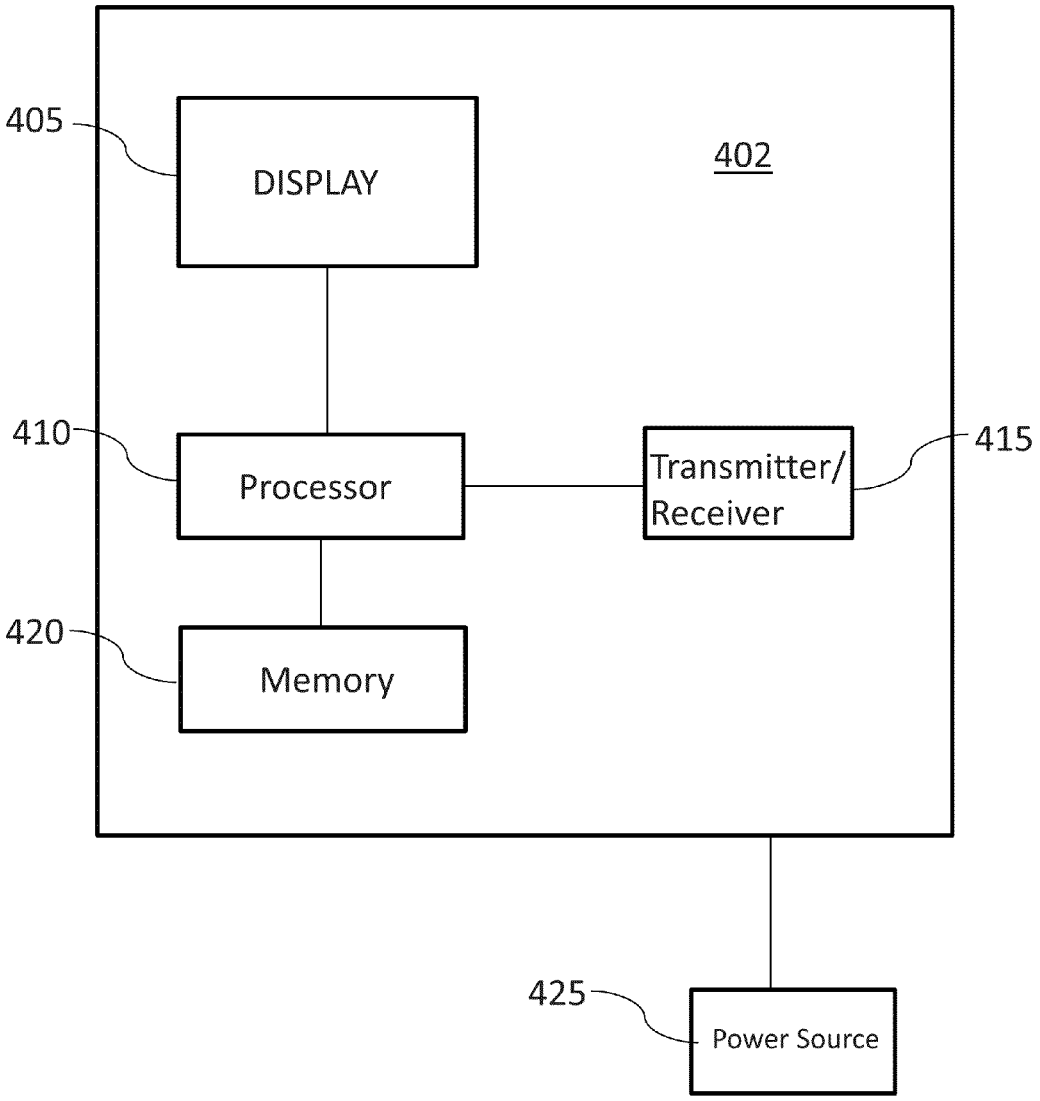
FIG. 7 is a schematic of the LED system in the cover device of FIGS. 6A, 6B, and 6C, according to embodiments of the invention.

As shown in FIG. 7, the LED system (402) on the cover device also includes a processor (410) which is in connection with a transmitter/receiver (415) and separately in connection with a memory source (420). The LED system (402) n ay also include a battery power supply (425), and/or photo cell power source. The power source may also include a cell phone connection for electronic advertisements. Electronic advertisements are advertisements including information such as news, displayed on an LED display. The LED system may also include a wireless network access point, e.g. Wifi and Bluetooth, that utilizes the transmitter/receiver of the LED system to transmit data. in some embodiments, the network access point on the cover device picks up signals from the surroundings (e.g. stores, businesses, stadiums) and provides updates on products or promotions from the surroundings (e.g. score updates and/or promotional products). In an additional embodiment, the power source and LED system communicate with other electronic devices, for example, an iPod, or similar devices.

While the present invention has been illustrated and described with reference to certain exemplary embodiments, those of ordinary skill in the art understand that various modifications and changes may be made to the described embodiments without departing from the spirit and scope of the present invention.

What is claimed is:

1. A gripping device for hygienically placing a lid on a container, the gripping device comprising:

an outer surface; and an inner wall comprising:

a continuous first engagement surface extending substantially around a first inner circumference of the inner wall and being sized to fit the lid of the container; and a continuous second engagement surface extending substantially around a second inner circumference of the inner wall and being sized to fit a second lid of a second container, the second inner circumference being longitudinally offset from the first inner circumference, and the second inner circumference being smaller than the first circumference, wherein only a portion of the continuous first engagement surface comprises a first sealing segment made from a material selected from the group consisting of a textured surface, a layer of adhesive, a rubber, a rubberized layer and combinations thereof.

2. The gripping device according to claim 1, wherein the inner wall further comprises a continuous third engagement surface being sized to fit a third lid of a third container.

3. The gripping device according to claim 1, wherein the first engagement surface and the inner wall are configured to contact at least two lids of differing types.

4. The gripping device according to claim 1, further comprising at least one advertisement space on a top surface of the gripping device or on the outer surface of the gripping device.

5. The gripping device according to claim 4, wherein the at least one advertisement space is configured to accommodate a print advertisement and/or an electronic advertisement.

6. The gripping device according to claim 4, wherein the advertisement space comprises a light emitting diode (LED) system.

7. The gripping device according to claim 6, wherein the LED system includes a display, a processor, a transmitter/receiver, a memory, and a power source.

8. The gripping device of claim 7, wherein the display is configured to display at least one electronic advertisement.

9. The gripping device of claim 7, wherein the transmitter/receiver of the LED system is a wireless transmitter/receiver that is configured to wirelessly transmit and receive data.

10. A method of hygienically placing a lid on a container using a gripping device, the gripping device comprising:

an outer surface, and an inner wall defining an inner cavity and comprising a continuous first engagement surface extending substantially around a first inner circumference of the inner wall and being sized to engage the lid of the container;

the method comprising:

gripping the lid by engaging the first engagement surface with the lid such that the lid is housed in the inner cavity of the gripping device;

placing the gripping device and lid housed in the gripping device on the container, and pressing the gripping device on the container until the lid engages the container; and after the lid engages the container, disengaging the lid from the first engagement surface by removing the gripping device from the container.

11. The method according to claim 10, wherein the first engagement surface is made from a material selected from the group consisting of a textured surface, a layer of adhesive, a rubber, a rubberized layer and combinations thereof.

12. The method according to claim 10, wherein the inner wall further comprises a second continuous engagement surface being sized to fit a second lid of a second container.

13. The method according to claim 12, wherein the inner wall further comprises a third continuous engagement surface being sized to fit a third lid of a third container.

14. The method according to claim 10, wherein the first engagement surface and the inner wall are configured to grip at least two lids of differing types.

* * * * *